United States Patent [19]

Konno

[11] Patent Number: 4,794,892

[45] Date of Patent: Jan. 3, 1989

[54] HYDRAULIC CIRCUIT FOR VALVE OPERATION TIMING CHANGING DEVICE FOR INTERNAL COMBUSTION ENGINE

[75] Inventor: Tsuneo Konno, Shiki, Japan

[73] Assignee: Honda Giken Kogyo Kabushiki Kaisha, Tokyo, Japan

[21] Appl. No.: 119,554

[22] Filed: Nov. 12, 1986

[30] Foreign Application Priority Data

Nov. 12, 1986 [JP] Japan ..... 61-269337

[51] Int. Cl.[4] ..... F01L 1/34; F01M 9/10

[52] U.S. Cl. ..... 123/90.16; 123/90.36

[58] Field of Search ..... 123/90.12, 90.16, 90.18, 123/90.36

[56] References Cited

U.S. PATENT DOCUMENTS 4,537,164 8/1985 Ajiki et al. ..... 123/90.16

4,537,165 8/1985 Honda et al. ..... 123/90.16

4,545,342 10/1985 Nakano et al. ..... 123/90.16 X 4,589,387 5/1986 Miura et al. ..... 123/90.16 X

*Primary Examiner*—Willis R. Wolfe

*Attorney, Agent, or Firm*—Lyon & Lyon

[57] ABSTRACT

A hydraulic circuit for a valve operation timing control device for supplying oil pressure through an oil passage defined in a rocker shaft to an actuator disposed in rocker arms which are pivotally supported on the rocker shaft for transmitting lifting motion from cams rotating in synchronism with the crankshaft of an engine to valves disposed in intake or exhaust ports of a combustion chamber. A solenoid-operated valve and flows restricting orifice are provided between the oil pump and oil passage for causing oil flow to the oil passage for lubrication even when the oil is cold and the actuator is not operated.

8 Claims, 2 Drawing Sheets

HYDRAULIC CIRCUIT FOR VALVE OPERATION TIMING CHANGING DEVICE FOR INTERNAL COMBUSTION ENGINE

The present invention relates to a hydraulic circuit for a valve operation timing changing device for changing the operation timing of valves disposed in intake ports or exhaust ports of a combustion chamber of an internal combustion engine.

As one method for controlling the power output of an internal combustion engine, it is known to vary the timing of opening and closing of valves disposed in intake or exhaust ports of a combustion chamber or to disable some of the valves dependent on a range of rotational speeds.

As one device for controlling such valve operation timing, there is known a mechanism for allowing a valve operating mechanism, such as the rocker arms, to have lost motion. The rocker arms are supported on a rocker shaft having an oil passage defined therein for supplying hydraulic oil pressure to a hydraulic actuator disposed in the rocker arms (see Japanese Laid-Open Patent Publication No. 61-19911).

It is necessary to supply the interior of the rocker shaft with lubricating oil for lubricating the shaft portions on which the rocker arms are pivotally supported. Heretofore, the working oil pressure for actuator is selectively supplied or completely cut off by a solenoid-operated valve which has a leakage passage. Normally, only a small amount of low-pressure lubricating oil is caused to flow in the rocker shaft through the leakage passage for attempting to improve responsive operation by continually purging air from the system, such as disclosed in U.S. Pat. No. 4,537,164. When the solenoid-operated valve is actuated, the interior of the rocker shaft is directly connected to the discharge port of a pump which supplies a sufficient oil pressure for operating the actuator to change the valve operation. However, under a cold condition of the engine the flowability of lubricating oil is low and the lubricating oil that has passed through the leakage passage of the solenoid-operated valve flows out a release port in the valve into the oil reservoir at a low resistance. Therefore, the amount of lubricating oil to flow into the rocker shaft tends to be insufficient for lubricating the rocker arms and filling all the passageways, thereby making the mechanism slow to warm up.

In view of the aforesaid difficulties of the prior art, it is a major object of the present invention to provide a hydraulic circuit for a valve operation timing control device that is capable of supplying a sufficient amount of lubricating oil into the rocker shaft even when the valve operation timing control device is not in operation.

The above object can be achieved by a hydraulic circuit for a valve operation timing control device for supplying oil pressure through an oil passage defined in a rocker shaft to an actuator disposed in rocker arms which are pivotally supported on the rocker shaft wherein one end of the oil passage in the rocker shaft communicates with a discharge port of an oil pump and the other end of the oil passage communicates with a release port coupled to the oil reservoir. With this arrangement, even when the actuator is not activated under cold operating conditions, a sufficient amount of lubricating oil will always flow through the rocker shaft.

Preferred embodiments of the present invention will hereinafter be described in detail with reference to the accompanying drawings, wherein.

Figure 1:
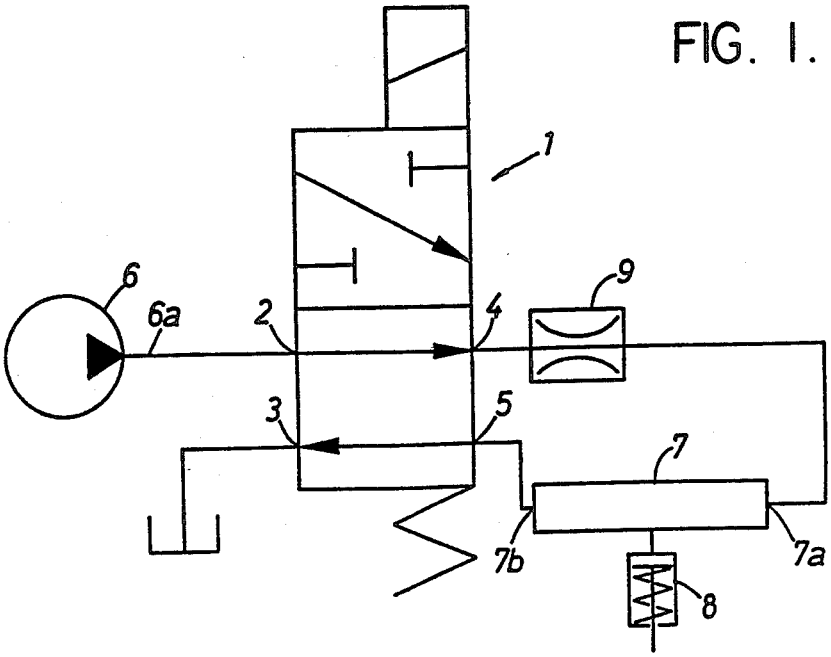
FIG. 1 is a diagram of a first embodiment of the hydraulic circuit of the present invention.

Referring now to FIG. 1, a solenoid-operated valve 1 is of a 4-port, 2-position configuration having a pump port 2, a return-to-reservoir tank port 3, a first output port 4, and a second output port 5. The solenoid-operated valve 1 is normally urged to a first position by a spring, and can be shifted to a second position when energized.

The pump port 2 is connected to the discharge port 6*a* of a lubricating oil pump 6, and the first and second output ports 4, 5 are connected respectively to the opposite ends 7*a*, 7*b* of a rocker shaft 7. The tank port 3 is open to the inside of the engine for returning oil to the reservoir from which the pump draws the oil. An actuator 8 of a valve operation timing control device is supplied with working oil from the rocker shaft 7.

The actuator 8 is normally urged toward one position by a coil spring. When oil pressure of a sufficient magnitude acts on the actuator 8, it is shifted to another position for thereby changing the valve operation timing.

The rocker shaft 7 has lubricating oil outlet holes for supplying lubricating oil to the shaft portions where rocker arms (not shown) are pivotally supported, as is well known in the art.

When the solenoid-operated valve 1 is de-energized, lubricating oil entering the solenoid-operated valve 1 through the pump port 2 and discharged out the first output port 4 flows through the rocker shaft 7 and the second output port 5 into the solenoid-operated valve 1, from which the lubricating oil is discharged via the tank port 3. Under this condition, the lubricating oil flowing into the rocker shaft 7 through an orifice 9 disposed in the passage from the pump port 2 to the end 7*a* of the rocker shaft 7 first flows through the rocker shaft 7 and then back through port 5 to valve 1 where it is immediately released through the tank port 3. Therefore, there is insufficient oil pressure acting on the actuator 8, to change its position where it remains inactivated. However, there is sufficient oil supply and pressure to lubricate the rocker arms as a result of the continuous flow through the rocker shaft.

When the solenoid-operated valve 1 is energized, the spool therein is displaced to cause lubricating oil that has entered via the pump port 2 to be discharged from the second output port 5, from which the lubricating oil enters the rocker shaft 7 through the other end 7*b*. Since the output port 4 is blocked or closed at this time, a closed hydraulic circuit is now established to allow sufficient oil pressure to act on the actuator 8 thereby to operate the actuator 8.

Figure 2:
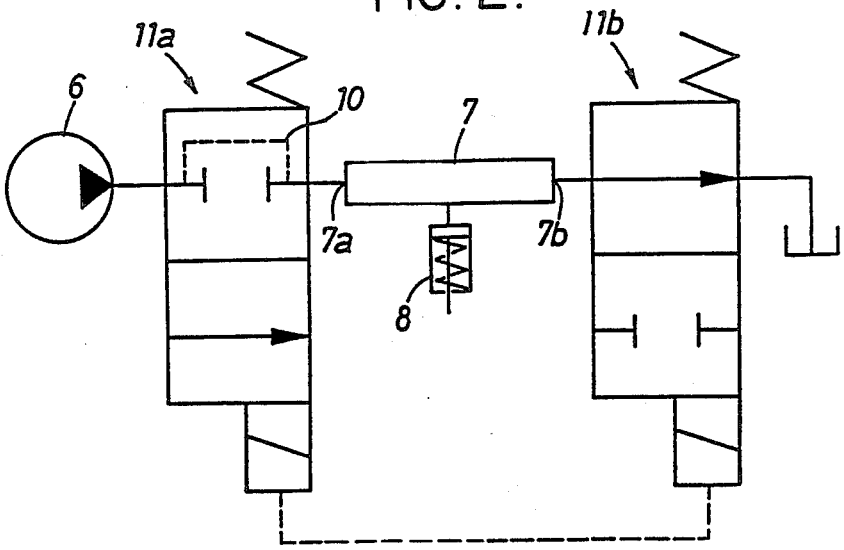
FIG. 2 is a diagram of a second embodiment of the hydraulic circuit of the present invention.

In the second embodiment, illustrated in FIG. 2, the opposite ends 7*a* and 7*b* of the rocker shaft 7 are coupled respectively to two 2-port, 2-position type solenoid-operated valves 11*a* and 11*b*. The solenoid-operated valve 11*a* is connected to the pump 6 and is closed when de-energized and opened when energized. The solenoid-operated valve 11*b* is connected to the oil reservoir in the engine and the valve is opened when de-energized and closed when energized.

A leakage passage 10 is defined in the solenoid-operated valve 11*a* on its closed position side. When the solenoid-operated valves 11*a*, 11*b* are de-energized, solenoid valve 11*a* is closed but lubricating oil from the pump flows through the leakage passage 10 across the solenoid-operated valve 11*a* into one end 7*a* of the rocker shaft 7 and out the other end 7*b*, and then passes through the solenoid-operated valve 11*b* into the engine reservoir.

When the solenoid-operated valves 11*a*, 11*b* are energized, the solenoid-operated valve 11*a* is opened and the solenoid-operated valve 11*b* is closed. Therefore, the full oil pressure from the pump is applied directly to the rocker shaft 7 to activate the actuator 8.

Figure 3:
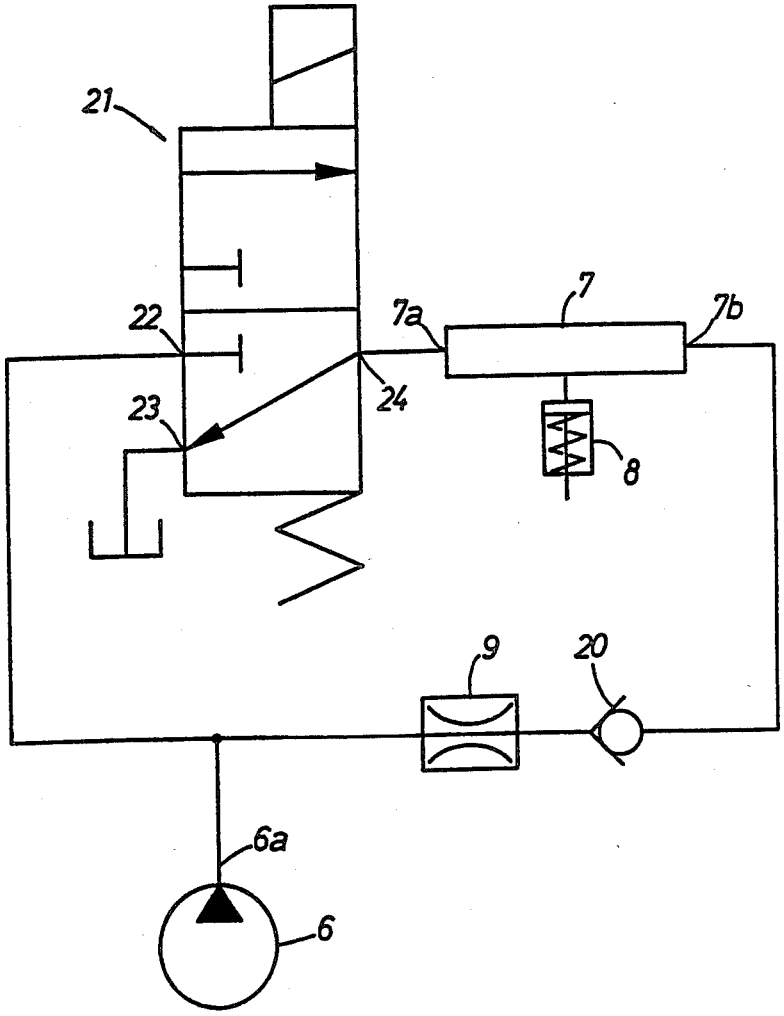
FIG. 3 is a diagram of a third embodiment of the hydraulic circuit of the present invention.

In the third embodiment of FIG. 3, the discharge port 6*a* of the pump 6 is branched into two passages, one of which is connected via aa solenoid-operated valve 21 to one end 7*a* of the rocker shaft 7. The other end 7*b* of the rocker shaft 7 is coupled through an orifice 9 and a check valve 20 to the other end 7*b* of the rocker shaft 7. The solenoid-operated valve 21 is of a 3-port, 2-position type, similar to the valve 1 of the first embodiment but without the second output ports of the first embodiment.

Upon de-energization of the solenoid-operated valve 21, lubricating oil discharged from the pump 6 passes through the orifice 9 into the end 7*b* of the rocker shaft 7, from which the lubricating oil flows via an output port 24 of the solenoid-operated valve 21 through the valve 21 and is then discharged from a tank port 23.

When the solenoid-operated valve 21 is energized, lubricating oil flows into the valve 21 from a pump port 22 and is discharged from the output port 24 into the end 7*a* of the rocker shaft 7. A closed hydraulic circuit is then established in the rocker shaft 7 by the check valve 20 for thereby applying the full oil pressure to and operating the actuator 8.

In the first and third embodiments, the orifice 9 may be replaced with either a temperature-sensitive valve which is open under cold conditions and progressively restricts the flow passage as the valve operating device warms up, or a pressure reducing valve having an output pressure setting lower than the pressure for operating the actuator 8.

With the present invention, as described above, even when an actuator is not in operation, a sufficient amount of lubricating oil is allowed to circulate through the rocker shaft by a simple arrangement. Inasmuch as the valve operating device will warm up quickly and trapped air will be reduced, the circuit arrangement is also effective in increasing oil pressure response and operation reliability.

What is claimed:

1. A hydraulic circuit for a valve operation timing control device for supplying oil pressure through an oil passage defined in a rocker shaft to an actuator disposed in rocker arms which are pivotally supported on the rocker shaft for transmitting lifting motion from cams rotating in synchronism with a crankshaft of an engine to valves disposed in intake or exhaust ports of a combustion chamber, comprising means for connecting one end of the oil passage in said rocker arm with a discharge port of an oil pump and the other end of the oil passage with an oil reservoir release when said actuator is not in operation under at least cold condition.

2. The hydraulic circuit of claim 1 wherein said connecting means includes a valve means for selectively stopping a full flow of oil from the oil pump to said oil passage in said cold engine condition and flow restricting means for allowing reduced pressure oil flow from the oil pump to said one end of the oil passage.

3. The hydraulic circuit of claim 2 wherein said valve means is selectively operable for supplying a full flow of oil from the oil pump into said other end of the oil passage for operating the actuator and reversing the oil flow direction through the oil passage of the rocker shaft.

4. The hydraulic circuit of claim 1 wherein said connecting means includes a first valve connected between said one end and said oil pump and a second valve between said other end and said oil reservoir.

5. The hydraulic circuit of claim 4 wherein said first valve has a leakage passage for supplying oil therethrough in the closed position.

6. The hydraulic circuit of claim 5 wherein said first valve is selectively closed and said second valve is selectively opened during the cold engine condition, and said first valve is selectively opened and said second valve is selectively closed for operation of said actuator.

7. The hydraulic circuit of claim 1 wherein said connecting means includes a flow restricting means and a check valve provided between said oil pump and said one end for allowing reduced-pressure oil flow from said oil pump to said one end.

8. The hydraulic circuit of claim 7 wherein said connecting means includes a selectively operable valve between said oil pump and the other end of the oil passage, said valve including means for connecting said other end to the oil reservoir and closing a connection between the oil pump and said other end in one position.

* * * * *